US009010446B2

(12) United States Patent
Fuhst et al.

(10) Patent No.: US 9,010,446 B2
(45) Date of Patent: Apr. 21, 2015

(54) DOWNHOLE CLAMPING MECHANISM

(75) Inventors: Karsten Fuhst, Niedersachsen (DE); Andreas Peter, Niedersachsen (DE); Matthias Moeller, Niedersachsen (DE); Christian Weiner, Niedersachsen (DE); Ulrich Michael, Niedersachsen (DE); William Befeld, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 342 days.

(21) Appl. No.: 13/400,780

(22) Filed: Feb. 21, 2012

(65) Prior Publication Data

US 2012/0211245 A1 Aug. 23, 2012

Related U.S. Application Data

(60) Provisional application No. 61/444,980, filed on Feb. 21, 2011.

(51) Int. Cl.

| | |
|---|---|
| ***E21B 23/00*** | (2006.01) |
| ***E21B 23/01*** | (2006.01) |
| ***E21B 23/04*** | (2006.01) |

(52) U.S. Cl.

CPC ..... *E21B 23/01* (2013.01); *E21B 23/04* (2013.01)

(58) Field of Classification Search

USPC ..... 166/382, 217, 212

See application file for complete search history.

(56) References Cited

U.S. PATENT DOCUMENTS

| | | | |
|---|---|---|---|
| 3,396,795 | A | 8/1968 | Venghiattis |
| 4,813,828 | A | 3/1989 | Beck et al. |
| 6,386,797 | B1 | 5/2002 | Gearhart |
| 6,821,063 | B2 | 11/2004 | Debat et al. |
| 6,868,901 | B2 | 3/2005 | Mason et al. |
| 6,962,216 | B2 | 11/2005 | Zupanick |
| 7,063,155 | B2 | 6/2006 | Ruttley |
| 7,478,982 | B2 | 1/2009 | Fuhst et al. |
| 2002/0014335 | A1 | 2/2002 | Doyle et al. |
| 2002/0043404 | A1 | 4/2002 | Trueman |
| 2002/0050409 | A1 | 5/2002 | Nackerud |
| 2003/0010497 | A1 | 1/2003 | Begg |
| 2003/0183424 | A1 | 10/2003 | Tulloch |
| 2004/0045714 | A1 | 3/2004 | McGavern |
| 2004/0129420 | A1 | 7/2004 | Hart |
| 2004/0182571 | A1 | 9/2004 | Betts |
| 2005/0023044 | A1 | 2/2005 | Schuffenhauer |

(Continued)

OTHER PUBLICATIONS

PCT International Search Report and Written Opinion of the International Searching Authority, dated Dec. 28, 2012; International Application No. PCT/US2012/025902; International Filing Date: Feb. 21, 2012.

*Primary Examiner* — Kenneth L Thompson
*Assistant Examiner* — Taras P Bemko
(74) *Attorney, Agent, or Firm* — Bracewell & Giuliani LLP

(57) ABSTRACT

An anchoring system for use with a downhole tool includes a body with anchor members mounted on the body that pivot radially outward from the body and into engagement with an inner surface of a tubular. Curved slots are provided along a portion of the members and a sliding block has a protrusion that projects into the slots. The slots are curved so that when the block is urged axially within the body, the interaction between the slots and protrusions pivots the members radially outward. A piston is urged through the body to drive the block. Optionally, an elongate helical gear may cooperate with grooves formed in an edge of the members so that rotating the gear pivots the members radially outward.

12 Claims, 11 Drawing Sheets

(56) References Cited

U.S. PATENT DOCUMENTS

| | | | | |
|---|---|---|---|---|
| 2005/0133224 | A1 | 6/2005 | Ruttley | |
| 2005/0173123 | A1 | 8/2005 | Lund | |
| 2006/0016603 | A1 | 1/2006 | Webster | |
| 2006/0137877 | A1 | 6/2006 | Watson | |
| 2006/0254773 | A1 | 11/2006 | Schlegelmilch | |
| 2007/0012449 | A1 | 1/2007 | Cruickshank | |
| 2009/0126926 | A1 | 5/2009 | Moore | |
| 2010/0101779 | A1 * | 4/2010 | Obrejanu | 166/216 |
| 2011/0005776 | A1 | 1/2011 | Reid | |

* cited by examiner 14
16
26
28
30
36
36,38
38
40
42
44
45

10A
14A
30A
20
60
59
52A
12A
26A
18
9
9

26A
36A
12A

DOWNHOLE CLAMPING MECHANISM

RELATED APPLICATIONS

This application claims priority to and the benefit of U.S. Provisional Application Ser. No. 61/444,980, filed Feb. 21, 2011, the full disclosure of which is hereby incorporated by reference herein.

BACKGROUND OF THE INVENTION

1. Field of Invention

The disclosure herein relates generally to the field of severing a tubular member. More specifically, the present disclosure relates to an apparatus for cutting downhole tubulars. Yet more specifically, described herein is a method and apparatus for anchoring a cutting tool within a downhole tubular 2. Description of Prior Art Tubular members, such as production tubing, coiled tubing, drill pipe, casing for wellbores, pipelines, structural supports, fluids handling apparatus, and other items having a hollow space can be severed from the inside by inserting a cutting device within the hollow space. As is well known, hydrocarbon producing wellbores are lined with tubular members, such as casing, that are cemented into place within the wellbore. Additional members such as packers and other similarly shaped well completion devices are also used in a wellbore environment and thus secured within a wellbore. From time to time, portions of such tubular devices may become unusable and require replacement. On the other hand, some tubular segments have a pre-determined lifetime and their removal may be anticipated during completion of the wellbore. Thus when it is determined that a tubular needs to be severed, either for repair, replacement, demolishment, or some other reason, a cutting tool can be inserted within the tubular, positioned for cutting at the desired location, and activated to make the cut. These cutters are typically outfitted with a blade or other cutting member for severing the tubular. In the case of a wellbore, where at least a portion of the casing is in a vertical orientation, the cutting tool is lowered into the casing to accomplish the cutting procedure.

BRIEF SUMMARY OF THE INVENTION

Disclosed herein is a system for anchoring a downhole tool and a method of downhole operations. An example of an anchoring system for use with a downhole tool includes a body having an axis and anchoring members with a base portion. The base portion pivotingly couples with the body along a line that is substantially parallel with the axis of the body. Also included with this embodiment is an anchoring portion on a side opposite the base portion, where the anchoring portion is moveable from a running position next to the body to a deployed position spaced radially outward from the body. An actuator is engaged with the base portions and a connector selectively couples with the downhole tool. In an example, the anchoring members have elongate sides that extend along a length of the body and when the base portion is in the running position, outer surfaces of the anchoring members on a side opposite the body lie along a curved path. Blocks are optionally included with the actuator, where the blocks project radially outward from the body and into slots formed along curved paths in the base portions. Thus when the blocks move axially within the body, interference between side walls of the slots and the blocks exerts a pivoting force onto the anchoring members that pivots the anchoring members into the deployed position. The slots may project along an edge of the base portion and a lower surface of the anchoring members that faces the body when the base portion is in the running position. A piston can optionally be included in the body that couples with the blocks and has an end in selective communication with a pressure source for urging the piston axially in the body. Helical grooves may optionally be included with the actuator that project radially outward from the body and into engagement with an actuation flap in the base portions. In this example when the grooves move axially within the body, interference between the grooves and actuation flap exerts a pivoting force onto the anchoring members that pivots the anchoring members into the deployed position. The anchoring system may optionally include an axial passage through the body.

In another example embodiment an anchoring system for use with a downhole tool is disclosed herein that includes an elongate anchoring member having generally parallel elongate sides that define a hinge end along one elongate side and an engaging end along an opposing elongate side. A hinge connection couples between the body and the hinge end of the anchoring member and an actuation member is selectively moveable with respect to the anchoring member. The hinge end of the anchoring member includes a profile engaged with a profile on the actuation member, so that when the actuation member moves with respect to the anchoring member, the anchoring member moves between a retracted position with the engaging end proximate the body and a deployed position with the engaging end pivoted away from the body. In one example, the anchoring member is a flap like member having a surface contoured along the width of the member that approximates a circle. The actuation assembly may optionally include a sliding block that slides within a curved slot in the hinge end of the anchoring member. The actuation assembly can also include a rotating helical gear. The profile on the hinge end of the anchoring member may include a helical gear meshed with the helical gear of the actuation assembly. The anchoring system can further include a plurality of anchoring members. A piston may optionally be included that is axially disposed within a cylinder in the body and engaged with the actuation assembly. In another example, a spring is included in the cylinder that is compressed when the anchoring member is deployed and expands to push against the piston as the anchoring member is retracted.

Also provided herein is a method of downhole operations that includes providing a downhole tool having an anchoring system. The anchoring system is made up of a body, an elongate anchoring member having generally parallel elongate sides that define a hinge end along one elongate side and an engaging end along an opposing elongate side, a hinge connection coupled between the body and the hinge end of the anchoring member, an actuation member selectively moveable with respect to the anchoring member, a profile on the hinge end of the anchoring member engaged with a profile on the actuation member. The method further includes anchoring the downhole tool in a tubular by moving the actuation member with respect to the anchoring member so that the anchoring member moves from a retracted position with the engaging end proximate the body to a deployed position with the engaging end pivoted away from the body. Optionally included with the method is a step of retracting the anchoring member by moving the actuation member to an original position.

BRIEF DESCRIPTION OF THE SEVERAL VIEWS OF THE DRAWING

Some of the features and benefits of the present invention having been stated, others will become apparent as the description proceeds when taken in conjunction with the accompanying drawings, in which.

Figure 1:
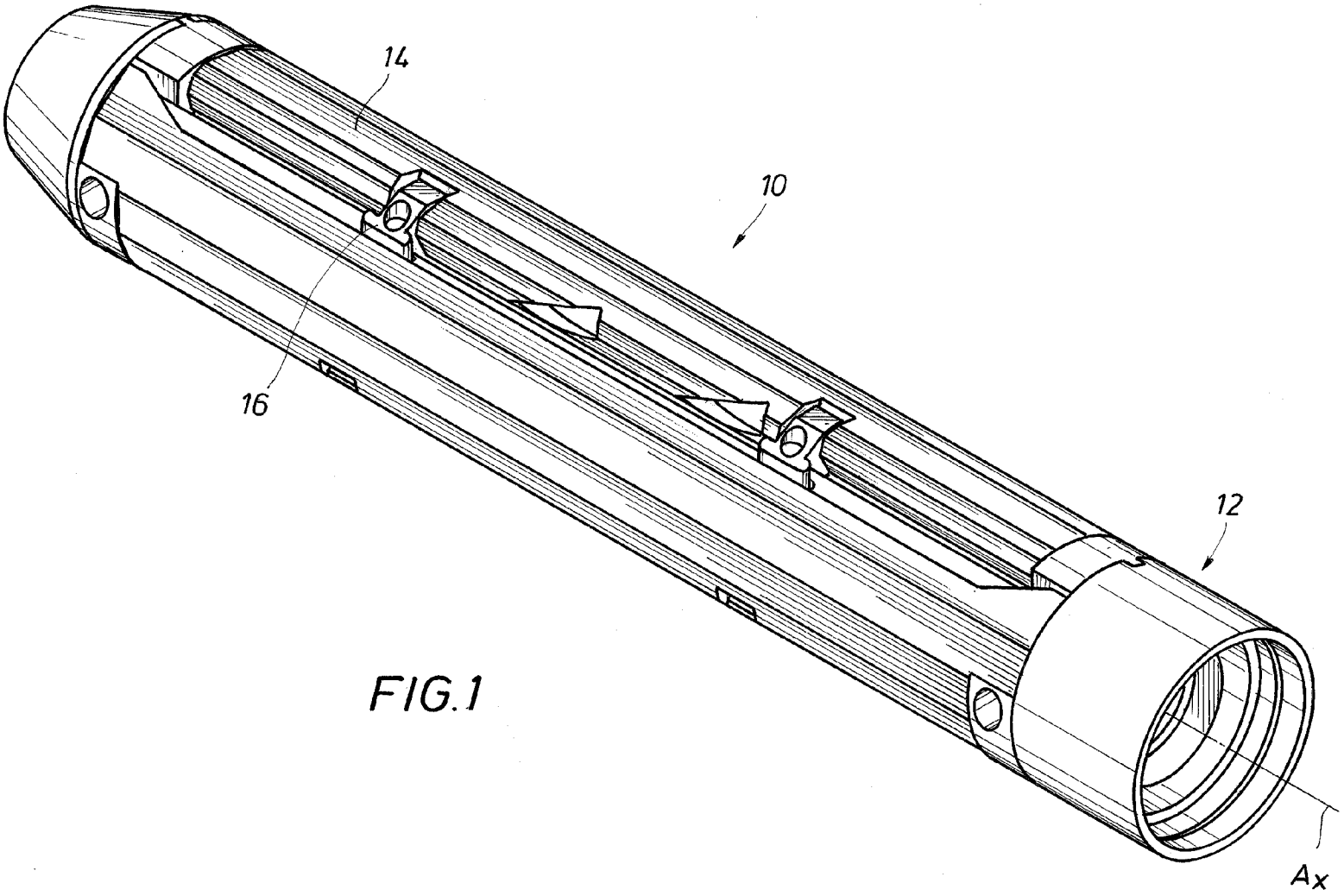
FIG. 1 is a side perspective view of an example embodiment of an anchoring sub.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Referring now to FIG. 1 an example embodiment of an anchoring sub 10 is shown in a side perspective view. In this example, the anchoring sub 10 includes a generally cylindrical body 12 shown equipped with anchoring members 14. The members 14 have elongate sides aligned with an axis $A_X$ of the body 12 and are pivotingly anchored to the body with hinge-like member supports 16. The supports 16 are shown mounted at discrete locations along a lateral edge of an elongate side of the anchor member 14. In the example of FIG. 1, the anchoring sub is in a "running" position with the anchoring members 14 retracted in line with the body 12 so that the anchoring sub 10 may be inserted within a tubular and pass freely within the tubular.

Figure 2:
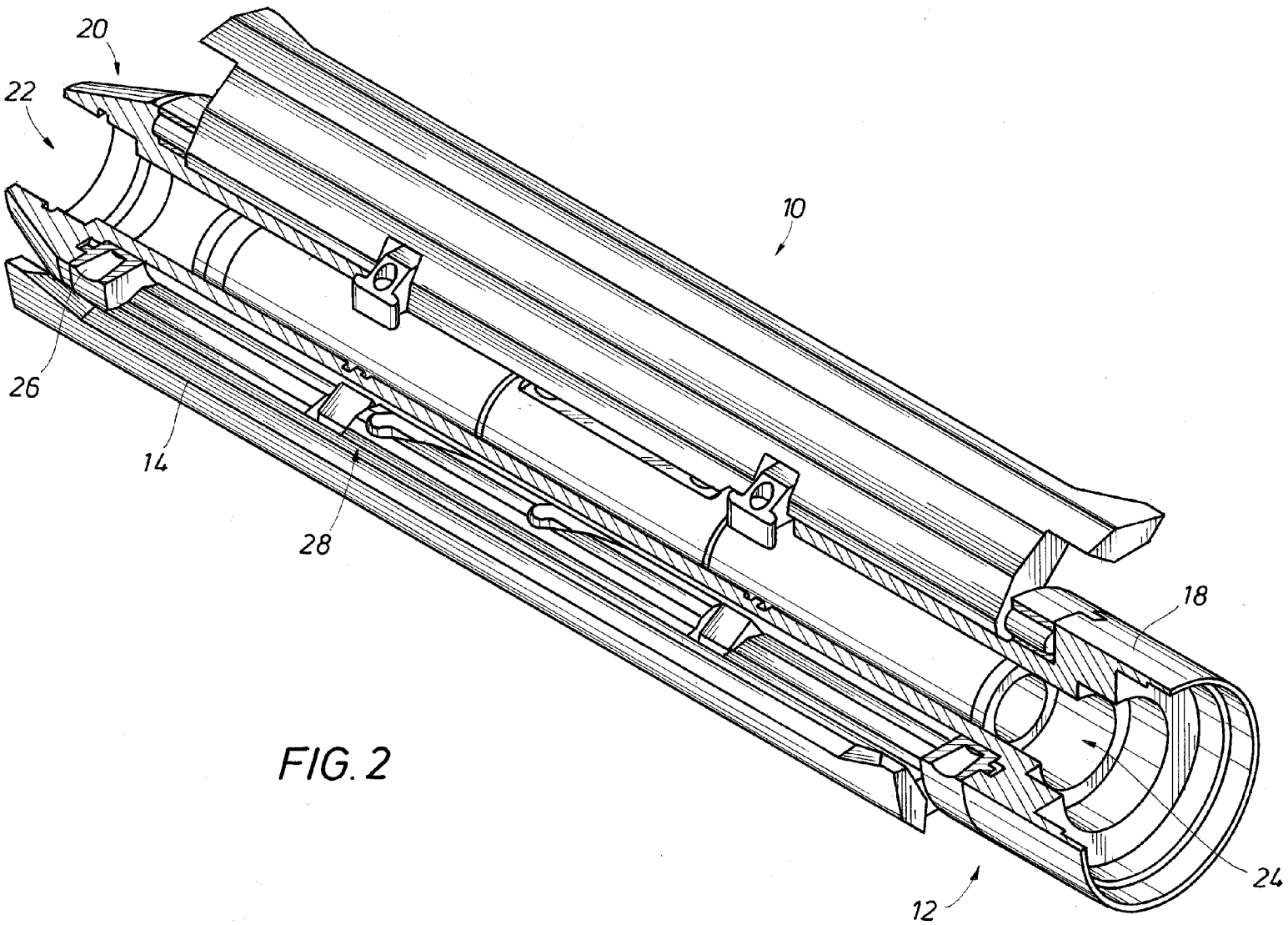
FIG. 2 is a side perspective view of the anchoring sub of FIG. 1 in a deployed configuration.

Referring now to FIG. 2, the anchoring sub 10 of FIG. 1 is shown in a deployed configuration with the anchor members 14 pivoted radially outward from their position in FIG. 1. To pivot outward, the members 14 rotate about pins (not shown) that project laterally from the member supports 16 and insert within a lateral end of the member 14. Annular end collars 18, 20 are shown disposed on an opposite ends of the body 12 and generally coaxial with the body 12. End collar 20 has an outer diameter that decreases with distance away from end collar 18 thereby providing a cone-like shape. An axial bore 22 projects lengthwise through the body 12.

Provided within the axial bore 22 is a cylindrically shaped actuating assembly 24. Bearing supports 26 are shown mounted at opposing ends of the anchoring members 14 and in a space between the members 14 and the end collars 18, 20. The bearing supports of FIG. 2 are generally block shaped members that anchor to the body 12 and have bores (not shown) that receive pins mounted in the anchoring members 14, thereby providing further structural support for the anchoring members 14 while allowing free pivoting along one of their elongate ends. Also shown in the example of FIG. 2 are curved slots 28 that are on a surface of the anchoring members 14 facing the bore 22 (lower side) when the anchoring sub 10 is in the running position of FIG. 1. In an example embodiment, at least a portion of the slot 28 faces radially outward from the anchoring sub 10 when in the deployed position of FIG. 2. As will be discussed in further detail below, the slots 28 extend along this lower side of the members 14 and through a lateral edge that is adjacent the body 12 when the members 14 are pivoted into the deployed position of FIG. 2. In an example embodiment, the slots 28 are provided in a base portion 30 of each member 14 that remains proximate the body 12 when the members 14 pivot between the running and deployed positions.

Figure 3:
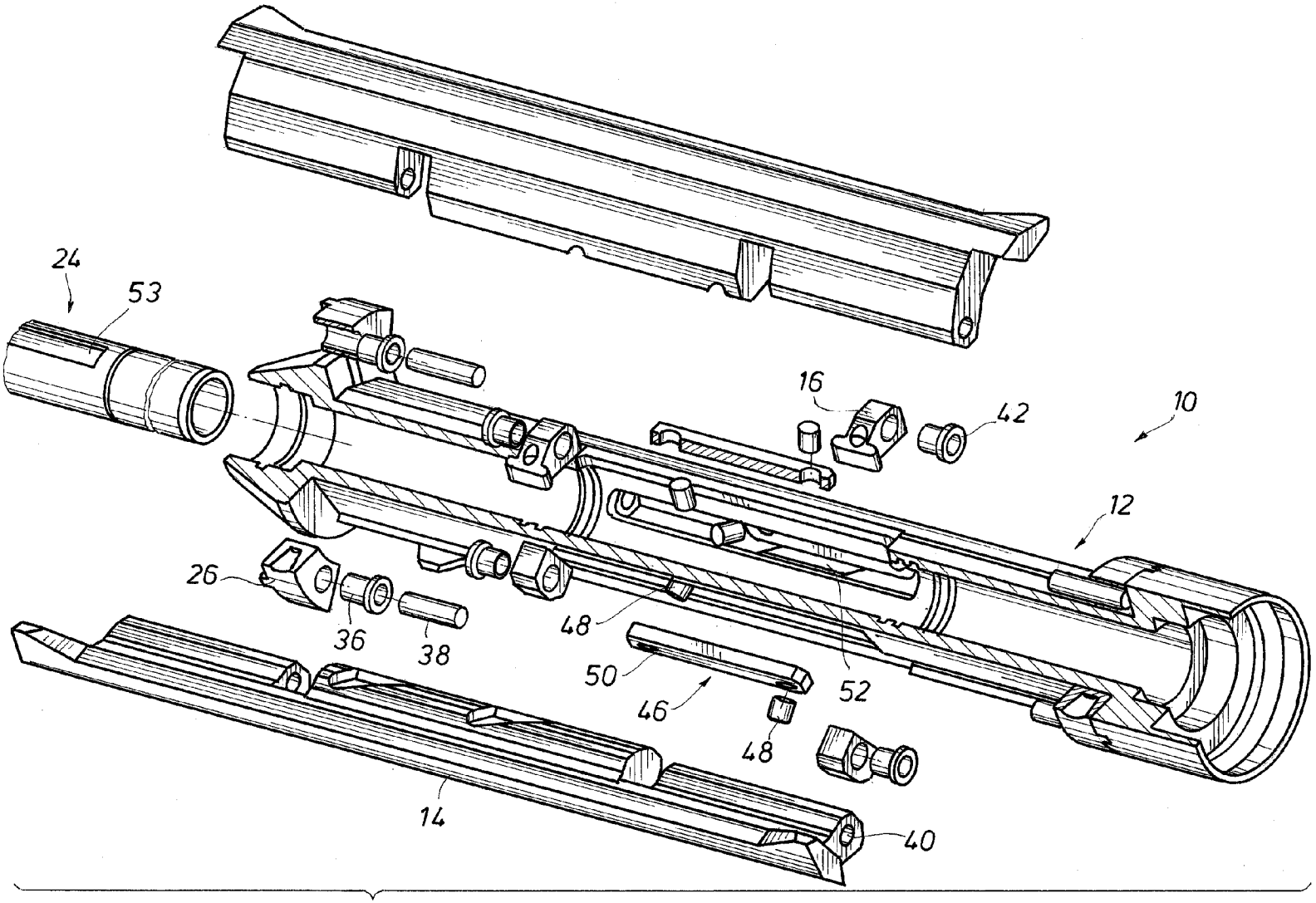
FIG. 3 is a side exploded view of the anchoring sub of FIG. 1.
Figures 4, 5:
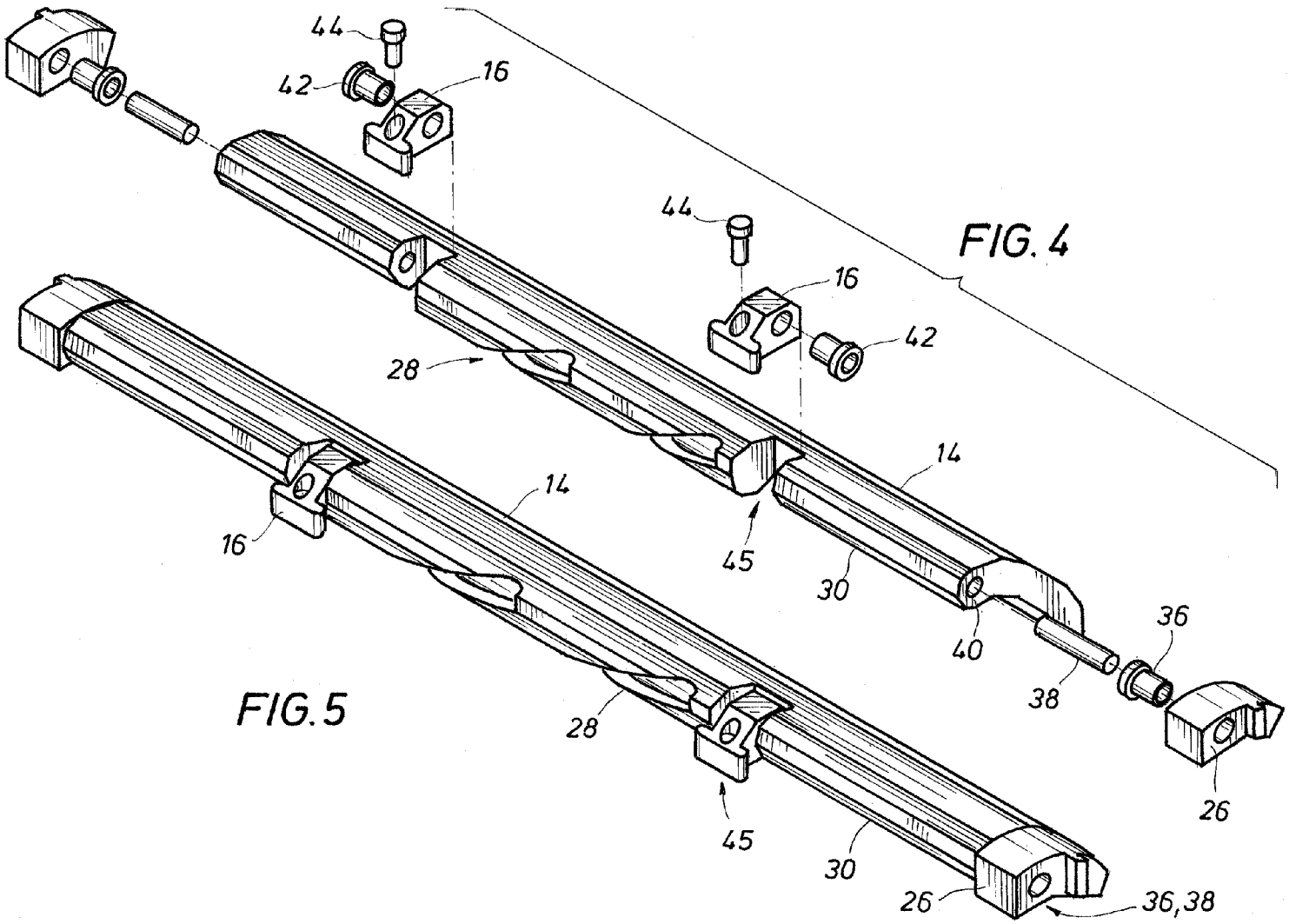
FIG. 4 is a side perspective and exploded view of a portion of the anchoring sub of FIG. 1.
FIG. 5 is a side perspective view of an example of an anchor member of the anchoring sub or FIG. 1.

An example of the anchoring sub 10 of FIG. 2 is provided in an exploded perspective view in FIG. 3. Components of the anchoring sub 10 shown include a bushing 36 and hinge pin 38 for rotatingly mounting the anchoring member 14 within the bearing support 26. The bushing 36 inserts into a bore in the bearing support 26 and the bushing 36 similarly receives the hinge pin 38 within a corresponding bore defining its inner circumference. Corresponding bores 40 are formed in the upper and lower terminal ends of the anchoring members 14 for receiving the end of the hinge pin 38 opposite its insertion into the bushing 36. Referring now to FIG. 4 shown in a perspective exploded view is an embodiment of member 14 with example hardware for pivotable mounting to the body 12. More specifically, illustrated in the embodiment of FIG. 4 is a bushing 42 for insertion into a side bore of the member support 16 so that a hinge pin (not shown) extending through the bore 40 and into the bushing 42 can make up the rotational coupling between the anchoring member 14 and member support 16. A bolt 44 is shown for securing the member support 16 to the body 12. Further depicted in the example of FIG. 4 are slots 45 formed transversely through the base portion 30 of the anchor members 14 that receive portions of the member supports 16 having the transverse bores with inserted bushings 42.

Referring back to FIG. 3, the example of the anchoring sub 10 includes a guide block 46 that as will be discussed in more detail below participates in actuation of the members 14. In the example of FIG. 3, the guide block 46 is made up of a sliding block 48 shown projecting laterally from an end of an elongate block base 50; where a width of the block base 50 exceeds a width of the sliding block 48. The sliding blocks 48 are illustrated as cylindrical members, but may alternatively be pins or spherical elements. In the partial cutaway exploded view of FIG. 3, illustrated is a body slot 52 that is formed through a side wall of the body 12; that extends lengthwise through the body 12 and generally within the mid portion of the body 12. In an example embodiment, the width of the slot 52 is greater than the width of each of the sliding blocks 48, but less than the width of the block base 50. Thus in an example, the sliding blocks 48 may project radially outward from within the body 12 and through the slots 52, whereas the wider block base 50 is retained within the body 12 being unable to pass through the slot 52. Also illustrated in FIG. 3 is a channel 53 shown provided lengthwise along the portion of the actuating assembly 24 and on the outer surface of the actuating assembly 24. In an example embodiment, the channel 53 is configured to accommodate the block base 50 therein.

A partially assembled embodiment of an anchoring member 14 is shown in a side perspective view in FIG. 5. In this embodiment the member supports 16 are shown set within the slots 45 on the base portion of the anchoring member 14. Additionally, ends of the curved slots 28 are shown extending along the lateral edge of the base portion 30 of the anchoring member 14. Comparing the views of FIG. 3 and FIG. 5, it can be seen that the slots 28 follow a curved path as they traverse between the upper and lower surfaces of the anchoring member 14.

Figure 7:
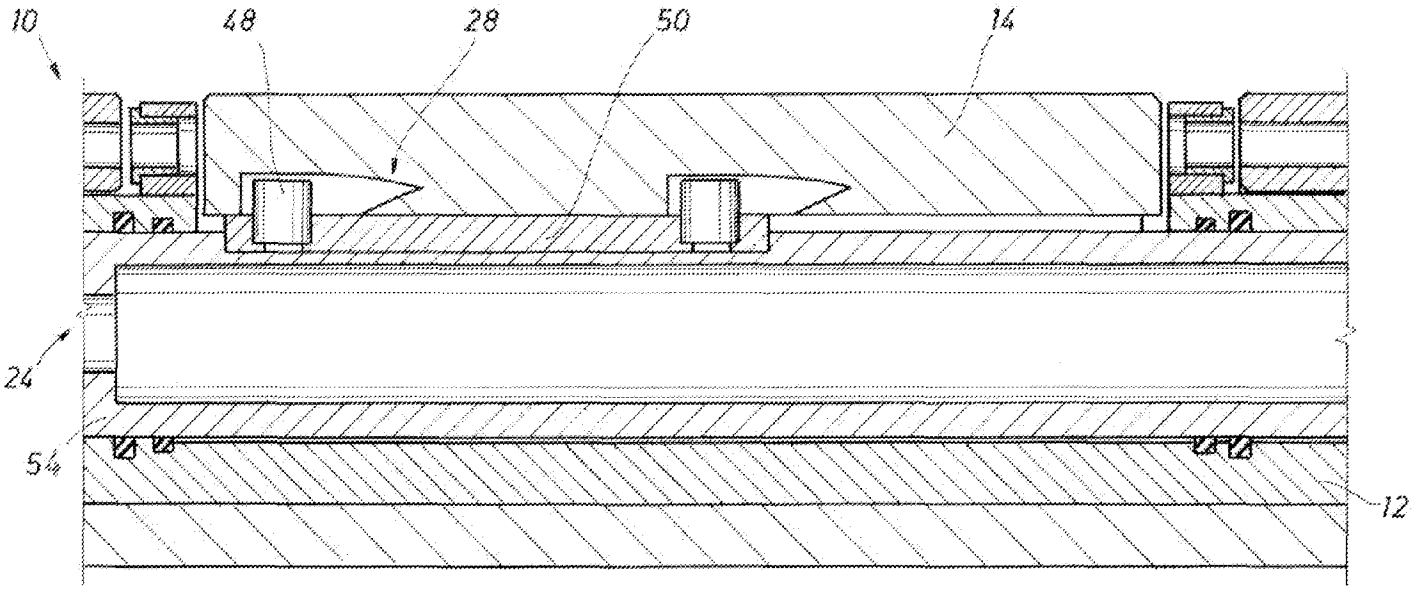
FIG. 7 is a side sectional view of a portion of the anchoring sub of FIG. 1.
Figure 6:
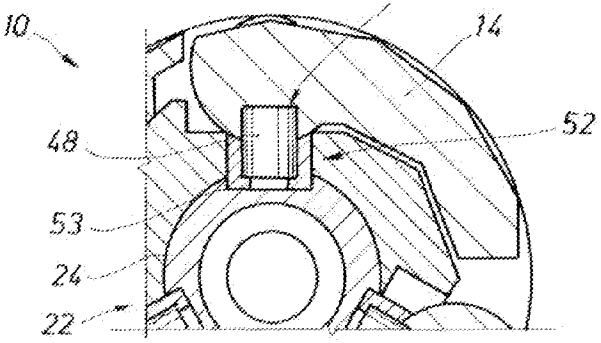
FIG. 6 is an axial sectional view of the anchoring sub of FIG. 1.

An axial sectional view of an example of the anchoring sub 10 is provided in FIG. 6. In this example, a sliding block 48 is shown set within a slot 28 and the anchoring member 14 is in a running position so that the lower surface of the anchoring member 14 is facing the bore 22. Also provided in the illustration of FIG. 6 is a lower side of the block base 50 set into the channel 53 in the actuation assembly 24 and resides in a space formed through the body 12 in the body slot 52. Referring now to FIG. 7 a side partial sectional view of an example of the anchoring sub 10 is illustrated. Here, the anchoring members 14 are shown in a running position with their lower surfaces facing the actuation assembly 24 and the sliding blocks 48 extending radially outward from the block base 50 to engage the slots 28. Further illustrated in the example of FIG. 7 is an annular piston 54 coaxially inserted within body 12, which as will be explained in further detail below is axially movable within the body 12 of the anchoring sub 10. As can be seen from the figures, axially urging the guide block 46 (FIG. 3) through the body 12 of the anchoring sub 10 urges the sliding blocks 48 along the path of the curved slots 28. The curvature of the slots 28 transfers the axially directed urging force from the sliding blocks 48 to the anchoring members 14, thereby pivoting the anchoring members 14 radially outward about their base portions 30 and into an engagement with a tubular (not shown). Applying an axial force to the piston 54, for example, can initiate the axial force for moving the guide block 46 that in turn deploys the anchoring members 14.

Figures 8, 9:
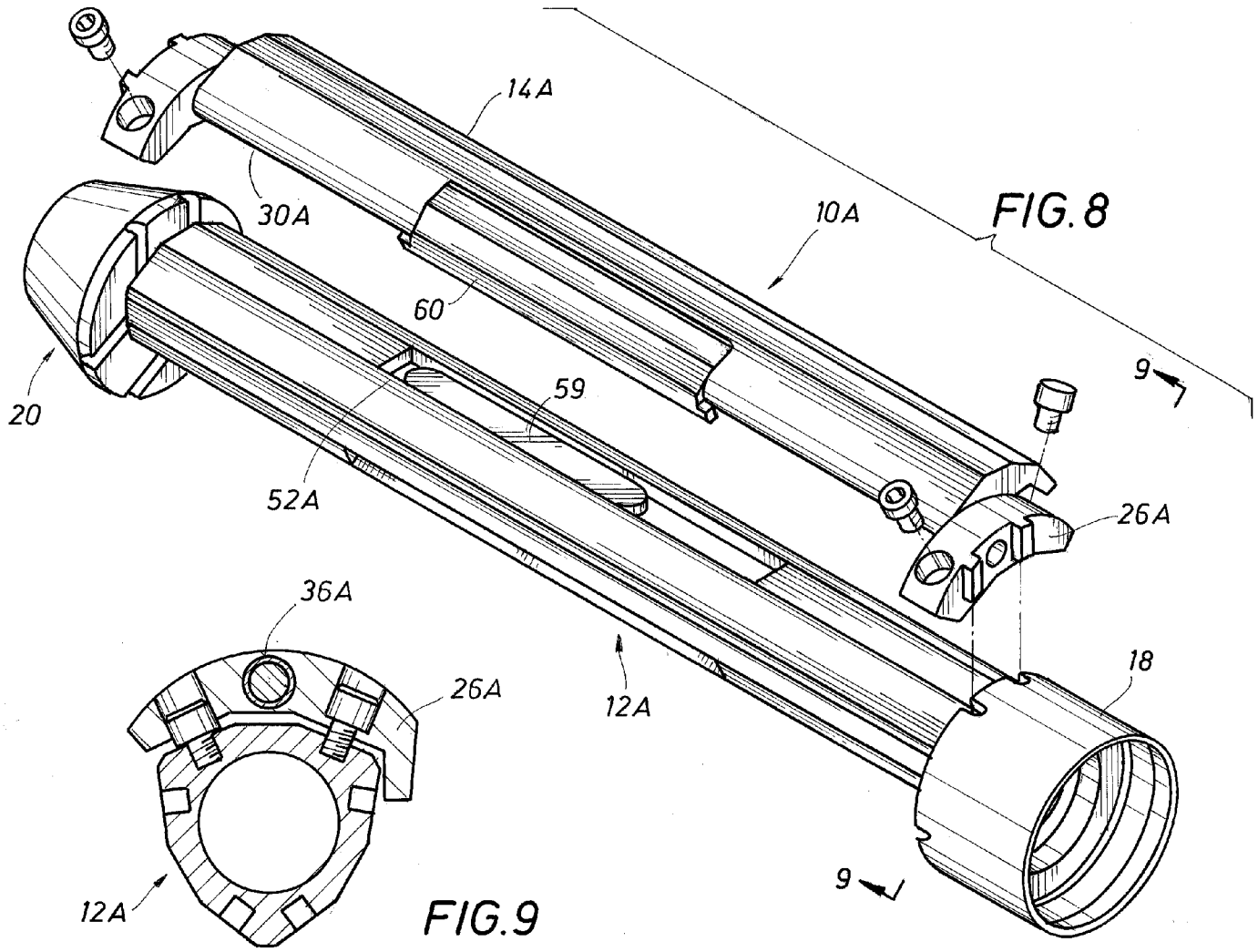
FIG. 8 is a side perspective and exploded view of an alternative embodiment of an anchoring sub.
FIG. 9 is a perspective sectional view of a portion of the anchoring sub of FIG. 8.

An alternative example of an anchoring sub 10A is shown in a side perspective, and partially exploded, view in FIG. 8. In this example, anchoring members 14 are mounted to a sub body 12A with crescent shaped bearing supports 26A through which a bearing end extends. The bearings are oriented along an axis of the body 12A and into a base portion 30A of the anchor member 14A. Bolts are shown for insertion into bolt holes provided on opposing ends of the bearing support 26A. The body 12A is shown having a body slot 52A formed axially in its outer surface and along a portion of its length; a helical gear 59 is in the body slot 52A having a portion set radially outward from the body 12A. An actuation flap 60, shown provided on a mid portion of the anchor member 14A is fitted with a groove (not shown) having teeth that mesh with the helical gear 59. In an example, rotating the helical gear 59 transfers the rotational force to the teeth in the actuating flap 60 and thus to the anchor member 14A for pivoting a lateral side of the anchor member 14A outward from the body 12A. Referring now to FIG. 9, shown is a sectional perspective view of the anchoring sub 10A of FIG. 8 taken along lines 9-9. In this example, a side bushing 36A is shown mounted in a bore of the bearing support 26A. Also, the body 12A is shown having an outer surface with three generally planar or faceted sides.

Figure 10:
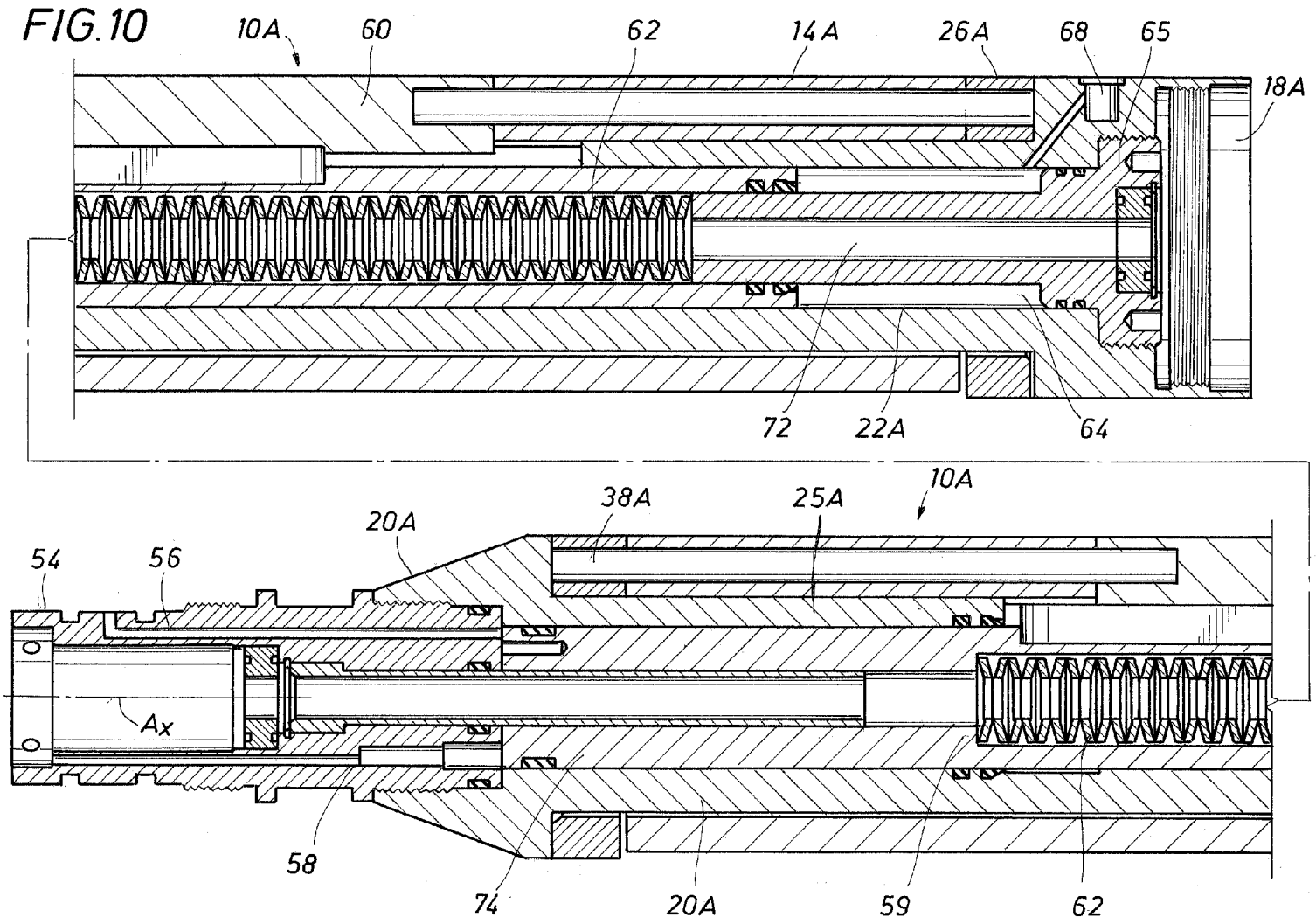
FIG. 10 is a side partial sectional view of the anchoring sub of FIG. 8.

FIG. 10 illustrates a side partial sectional view of the anchoring sub 10A of FIG. 8 taken along lines 10-10. In this example, the anchoring sub 10A is in the running position with the anchor members 14A in a stowed position and adjacent the body 12A. Further provided in this embodiment is an annular anchor mount 55 that is threadingly attached within an open end of end collar 20A. A hydraulic passage 56 for delivering hydraulic fluid to an end of the piston 54A is shown in the anchor mount 55. The passage 56 extends axially through the body of the anchor mount 55 exiting the end of the anchor mount 55 facing the bore 22A; distal from the collar 20A the passage 56 transitions from an axial path to a radial outward path and intersects a side wall of the anchor mount 55. A rod like piston anchor 61 that extends from within the anchor mount 55 and the piston 54A slidingly mounts on the piston anchor 61 distal from the anchor mount 55. Further illustrated in the example of FIG. 10 is a cavity coaxially formed in the piston 54A on a side distal from the anchor mount 55, where the cavity receives a spring 62 therein. An annular plenum 64 is shown that extends radially inward from an inner surface of the bore 22A to substantially cylindrical base mandrel 65.

The embodiment of the base mandrel 65 of FIG. 10 is substantially coaxial with the bore 22A. Proximate collar 18A the anchor mount 65 is radially enlarged and transitions to a smaller diameter away from the collar 18A; the reduced diameter portion of the base mandrel 65 slidingly inserts into an end of the cavity in the piston 54A. The terminal end of the anchor mount 65 distal from the collar 18A provides an axial support for the spring 62. Thus the spring 62 is set between the closed end of the cavity and terminal end of the base mandrel 65. The radius transitions within the base mandrel 65 increase its radius with distance away from the spring 62. Seals are provided in an outer circumference of a portion of the base mandrel 65 for isolating pressure within the plenum 64. The plenum 64 may be filled with a hydraulic fluid, so that translating the piston 54A in a direction towards the end collar 18A evacuates fluid from the plenum 64. A passage 66 is shown provided through the body 12A for evacuating matter, such as hydraulic fluid, ambient fluid (such as wellbore fluids), or other flowable material, from within the plenum 64 as the piston 54A is urged within the anchoring sub 10A and along its axis $A_X$. An optional screen 68 is shown at the outer end of the passage 66 for filtering any debris from material flowing through the passage 66.

Figure 11:
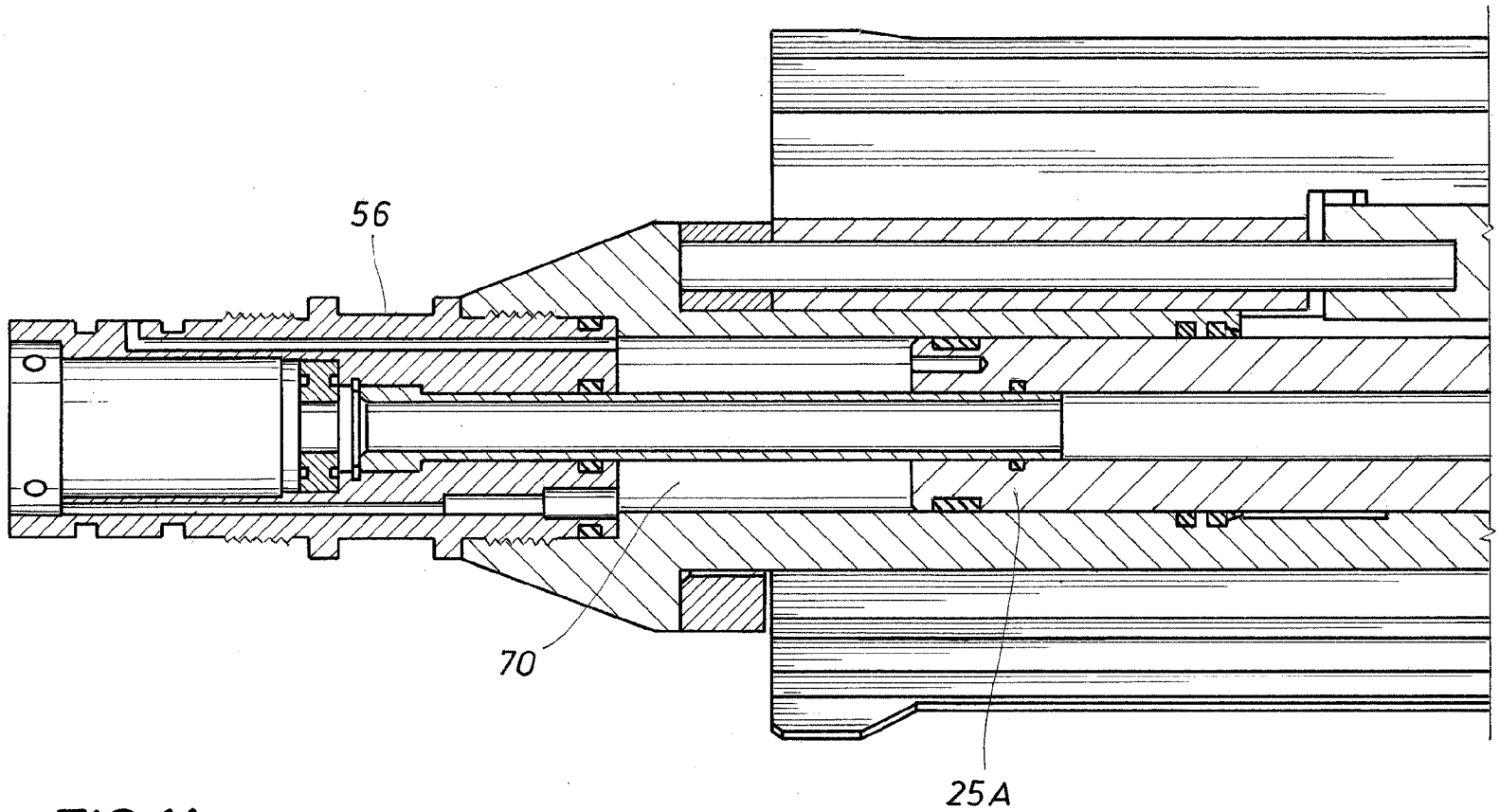
FIG. 11 is a side partial sectional view of the anchoring sub of FIG. 8 and shown in a deployed configuration.
Figure 11:
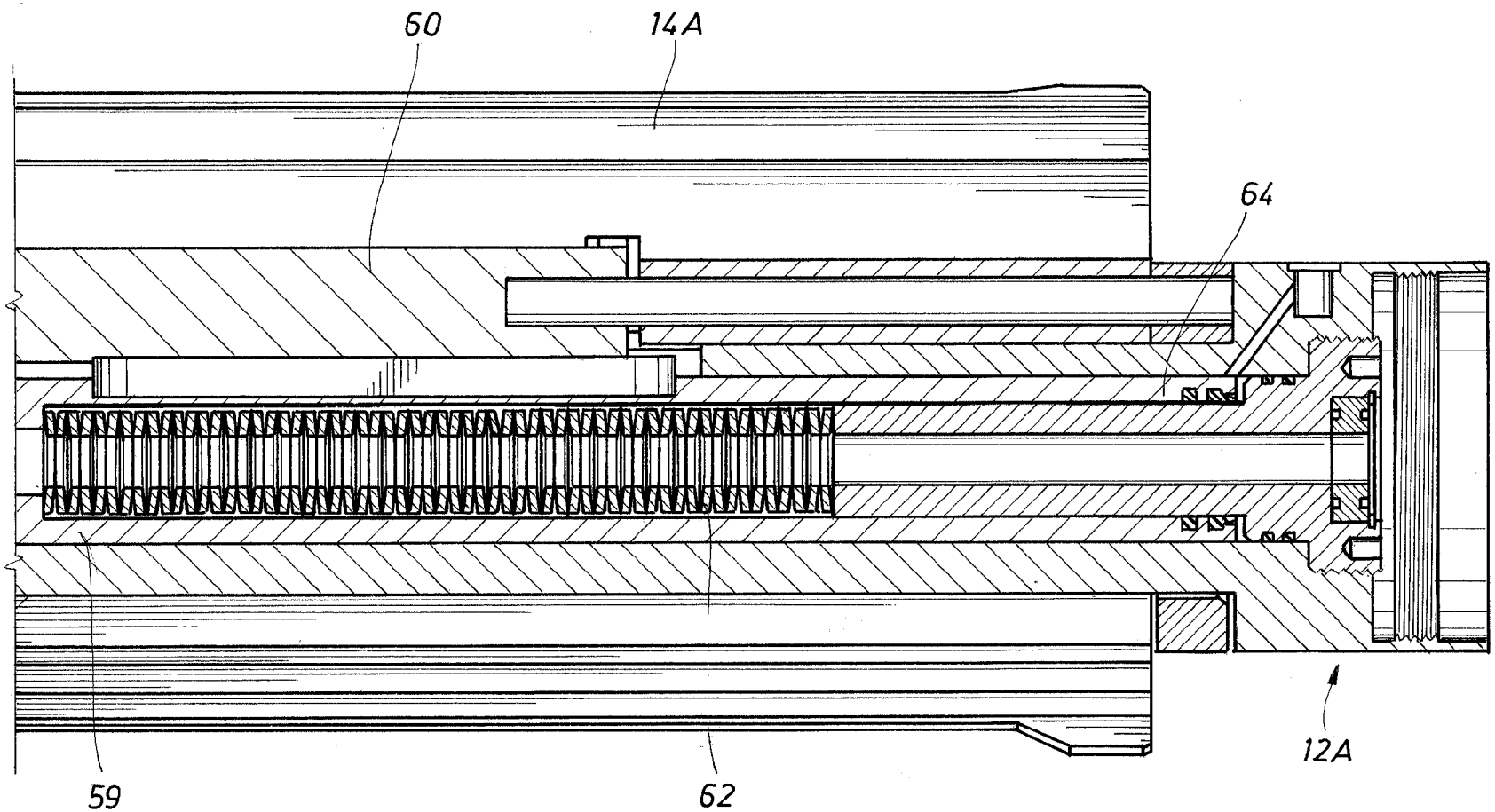

An example of deploying the anchoring member 14A is shown in a side partial sectional view in FIG. 11, where the anchoring member 14A is deployed radially out from the body 12A. The anchoring member 14A can be deployed as shown by introducing hydraulic fluid through the passage 56 to an upstream side of the piston 54A, thereby urging the piston 54A axially within the anchoring sub 10A in a direction away from the hydraulic passage 56. Further shown in the embodiment of FIG. 11 is that the piston 54A has laterally moved in the bore 22A thereby translating the helical gear 59 against the grooves on the actuation flap 60 to rotate the anchor member 14A. The bearing support 26A and hinge pins 38A pivotingly retain the elongate base end of the anchor member 14A proximate the body 12A and allowing the free end of the anchor member 14A to pivot radially outward into an anchoring position (FIG. 11).

As illustrated in the example of FIG. 11, a space 70 is created in the bore 22A by moving the piston 54A away from the hydraulic passage 56 and towards collar 18A. In addition to deploying the anchor member 14A into an anchoring position, moving the piston 54A axially as shown in FIG. 11 also compresses the spring 62 against the base mandrel 65 storing potential energy in the compressed spring 62. Sealing the hydraulic passage 56, such as with an upstream valve (not shown), can maintain pressure in space 70 thereby perpetuating an axial force against the piston 54A to retain it in the position of FIG. 11. Referring back to the example of FIG. 10, an axial bore 72 is illustrated extending through the piston anchor 61, piston 54A, and base mandrel 65. In an example embodiment, the axial bore 72 provides fluid communication for hydraulics of the anchoring sub 10A. An optional seal 74 is shown on the outer circumference of the piston anchor 61 to define a pressure barrier between the bore 72 and interface of the piston anchor 61 and piston 54A.

Figure 12:
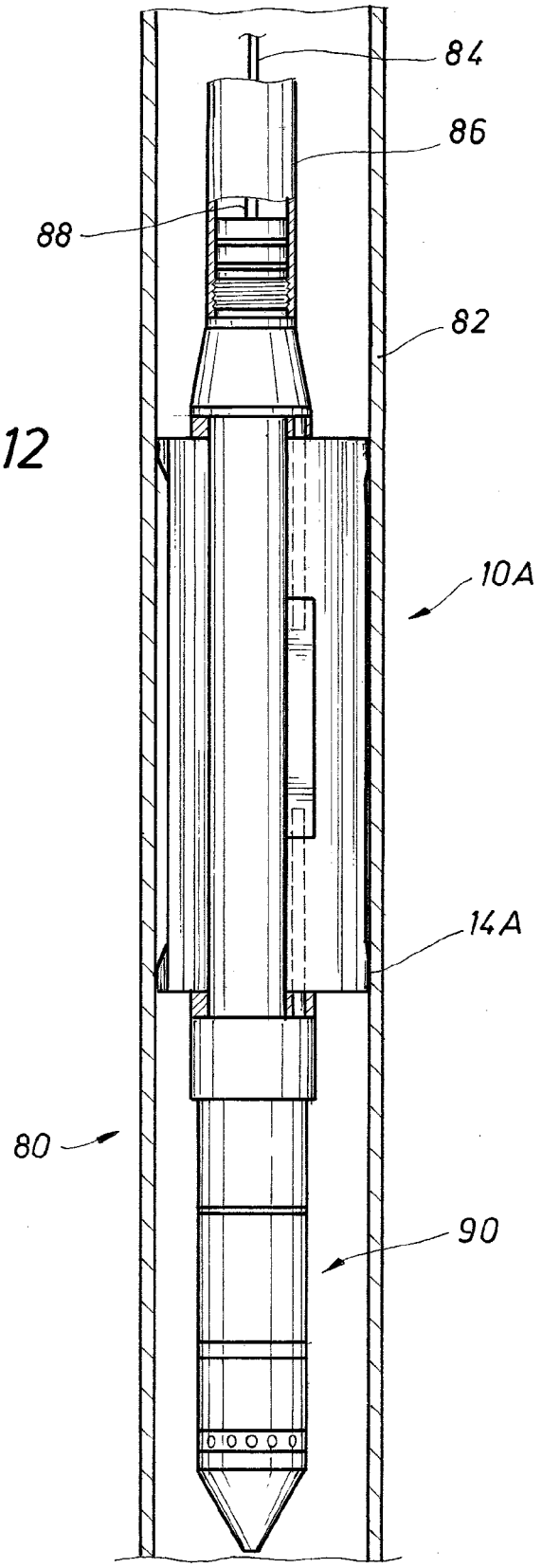
FIG. 12 is a side partial sectional view of an example embodiment of an anchoring sub anchoring a downhole tool within a tubular.

Referring now to FIG. 12, a side partial sectional view of an example embodiment of an anchoring sub 10A is shown coupled with a downhole tool 80 on its lower end. The anchoring sub 10A is depicted in a deployed position with its anchoring members 14A radially extended from the body 12A and into engagement with an inner circumference of tubing 82. In this example, the downhole tool 80 is a cutting tool for cutting a tubular. The anchoring sub 10A and tool 80 are shown suspended on wire line 84 that can also provide signal and power to the anchoring sub 10A and/or tool 80. Optionally, tubing or slick line may be used in lieu of the wire line 84. A motor section 86 is shown coupled to an end of the anchoring sub 10A that includes a drive shaft 88 from the motor for powering embodiments of the anchoring sub 10A as well as a cutting head 90 shown disposed on a lower end of the downhole tool 80. Thus in one example embodiment, the tool 80 can be lowered within the tubular 82, the anchoring sub 10A put into a deployed position with the anchoring members 14A radially extended from the body to anchor the tool 80 within the tubular 82. Subsequently, power can then be provided to the cutting head 90 for severing the tubular 82 while the tool 80 is held at a designated depth and orientation within the tubing 82.

Referring now to FIGS. 11 and 12, the springs 62 are shown in the compressed state with lateral movement of the piston 54A as shown in FIG. 11. By relieving pressure within the space 70, the force stored in the compressed springs 62 may then urge the piston 54A and attached helical gear 59 for retracting the anchoring members 14A back into the running position (FIG. 10); thereby allowing removal of the tool 80 from within the tubular 82. It should be pointed out that the piston assembly illustrated in the sectional views of FIGS. 10 and 11 can be applied with the sub embodiments of FIGS. 1 through 7 for axially motivating the guide blocks 46 and in turn pivot anchor members 14 into anchoring engagement with a tubular.

Figure 13:
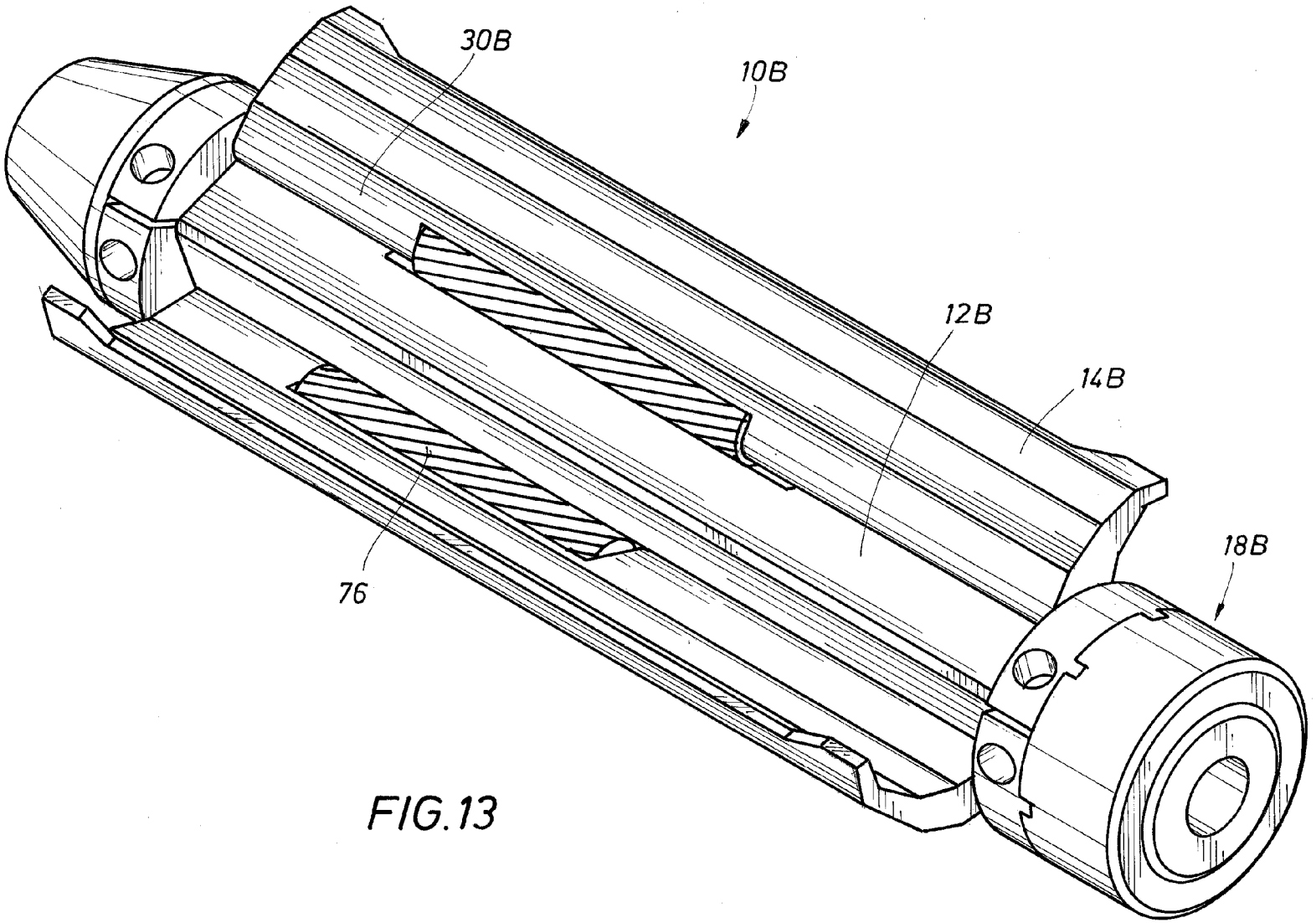
FIG. 13 is a side perspective view of an additional alternate embodiment of an anchoring sub in a deployed configuration.

Shown in a perspective view in FIG. 13 is yet another example embodiment of an anchoring sub 10B. In this example, helical gears 92 are shown mounted within the base portion 30B of an anchoring member 14B. The helical gears 92 are elongate along the length of the anchoring member 14B having teeth that whose cross section follow a helical path on an outer surface of the gears 92. A similarly profiled gear (not shown) may be rotatingly disposed within the body 12B of the anchoring sub 10B and when rotated accordingly can deploy and retract the anchoring members 14B as desired.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. An apparatus for use downhole comprising:
a downhole tool; and
an anchoring system comprising,
a body having an axis,
anchoring members each having a base portion pivotingly coupled with the body along a line substantially parallel with the axis of the body, and an anchoring portion spaced apart from the base portion that is moveable from a running position proximate the body to a deployed position spaced radially outward from the body,
an actuator engaged with the base portions, and that comprises blocks that project radially outward from the body and into slots formed along curved paths in the base portions, so that when the blocks move axially within the body, interference between side walls of the slots and the blocks exerts a pivoting force onto the anchoring members that pivots the anchoring members into the deployed position, and
a connector selectively coupled with the downhole tool.

2. The apparatus of claim 1, wherein the anchoring members have elongate sides that extend along a length of the body and when the base portion is in the running position, outer surfaces of the anchoring members on a side opposite the body lie along a curved path.

3. The apparatus of claim 1, wherein the slots project along an edge of the base portion and a lower surface of the anchoring members that faces the body when the base portion is in the running position.

4. The apparatus of claim 1, further comprising an axial passage through the body.

5. The apparatus of claim 1, wherein the downhole tool comprises a tool for severing a downhole tubular.

6. An apparatus for use downhole comprising:
a downhole tool; and
an anchoring system comprising:
an elongate anchoring member having generally parallel elongate sides that define a hinge end along one of the elongate sides and an engaging end along a distally disposed elongate side;
a hinge connection coupled between a body of the anchoring system and the hinge end of the anchoring member;
an actuation member selectively moveable with respect to the anchoring member; and that comprises blocks that project radially outward from the body and into slots formed along curved paths in the base portions, so that when the blocks move axially within the body, interference between side walls of the slots and the blocks exerts a pivoting force onto the anchoring members that pivots the anchoring members into the deployed position;
a profile on the hinge end of the anchoring member engaged with the actuation member, so that when the actuation member moves with respect to the anchoring member, the anchoring member moves between a retracted position with the engaging end proximate the body and a deployed position with the engaging end pivoted away from the body.

7. The apparatus of claim 6, wherein the anchoring member comprises a flap like member having a surface contoured along the width of the member that approximates a circle.

8. The apparatus of claim 6, further comprising a curved slot that extends along a lower side of the anchoring and along an edge of the anchoring member and wherein the actuation member comprises a sliding block slidably inserted into the curved slot.

9. The apparatus of claim 6, further comprising a plurality of anchoring members.

10. The apparatus of claim 6, further comprising a piston axially disposed within the body and engaged with the actuation member.

11. A method of downhole operations comprising:

providing a downhole tool having an anchoring system comprising, a body, an elongate anchoring member having generally parallel elongate sides that define a hinge end along one elongate side and an engaging end along an opposing elongate side, a hinge connection coupled between the body and the hinge end of the anchoring member, an actuation member selectively moveable with respect to the anchoring member, a block on the actuation member, a curved slot on the hinge end of the anchoring member engaged with the block on the actuation member; and anchoring the downhole tool in a tubular by moving the block of the actuation member with respect to the anchoring member and along the slot, so that the anchoring member moves from a retracted position with the engaging end proximate the body to a deployed position with the engaging end pivoted away from the body.

12. The method of claim 11, further comprising retracting the anchoring member by moving the block of the actuation member to an original position.

* * * * *